US005567479A

United States Patent [19]

Rantanen

[11] Patent Number: 5,567,479

[45] Date of Patent: Oct. 22, 1996

[54] METHOD AND DEVICE FOR COATING THE FACE OF A ROLL IN A FILM SIZE PRESS

[75] Inventor: Rauno Rantanen, Muurame, Finland

[73] Assignee: Valmet Corporation, Helsinki, Finland

[21] Appl. No.: 165,214

[22] Filed: Dec. 10, 1993

[30] Foreign Application Priority Data

Dec. 15, 1992 [FI] Finland ..... 925704

[51] Int. Cl.[6] ..... B05D 3/12; B05C 1/08; B05C 11/02

[52] U.S. Cl. ..... 427/359; 427/428; 15/256.52; 118/104; 118/262; 118/110

[58] Field of Search ..... 15/256.5, 256.51, 15/256.52; 118/104, 261, 110, 112, 119, 262; 427/356, 359, 428

[56] References Cited

U.S. PATENT DOCUMENTS

| | | | |
|---|---|---|---|
| 3,166,464 | 1/1965 | Eolkin | 15/256.51 |
| 3,701,335 | 10/1972 | Barnscheidt | 15/256.52 |
| 5,122,396 | 6/1992 | Rantanen | 427/359 |
| 5,179,909 | 1/1993 | Sollinger | 15/256.52 |
| 5,219,618 | 6/1993 | Daniels | 427/356 |
| 5,246,497 | 9/1993 | Rantanen | 118/249 |
| 5,372,644 | 12/1994 | Kochsmeier | 118/262 |

FOREIGN PATENT DOCUMENTS

| | | |
|---|---|---|
| 83598 | 4/1991 | Finland . |
| 912260 | 5/1991 | Finland . |

*Primary Examiner*—Katherine Bareford
*Attorney, Agent, or Firm*—Steinberg, Raskin & Davidson, P.C.

[57] ABSTRACT

A method and device for coating of the face of a roll in a film size press with a coating agent by a coating device including a coating doctor that extends across the machine width and is loaded against the face of a roll in the film size press. The coating doctor spreads and smooths the coating agent, which has been introduced into the coating device and applied as a film onto the roll face before the coating doctor in the direction of rotation of the roll. To prevent the formation of streaks in the coating-agent film, in particular of streaks resulting from cavitation, adhesion of coating agent from the coating-agent film to the trailing side of the coating doctor is prevented by keeping the trailing side of the coating doctor moist or wet. Adhering of coating agent to the trailing edge of the coating blade is prevented by feeding a moistening medium as a constant flow to the area of the trailing edge. The moistening medium is introduced into the area of the trailing edge of the coating blade by spraying or atomizing.

21 Claims, 4 Drawing Sheets

METHOD AND DEVICE FOR COATING THE FACE OF A ROLL IN A FILM SIZE PRESS

BACKGROUND OF THE INVENTION

The present invention relates to a method for coating the face of a roll in a film size press with a coating agent by a coating device in which a coating doctor extends across the machine width. The coating agent is introduced into the coating device before the coating doctor in the direction of rotation of the roll, as a film onto the roll face. The coating doctor is loaded against the face of the roll in the film size Dress so that the coating doctor spreads and smooths the coating agent on the roll.

The present invention also relates to a device for coating the face of a roll in a film size press by means of a coating device having a coating doctor which extends across the machine width. The coating agent is directed from the coating device against the roll before the coating doctor in the direction of rotation of the roll. The coating doctor is loaded against the face of the roll in the film size press so that the coating doctor spreads and smoothes the coating agent introduced from the coating device as a film onto the roll face.

Currently, in surface sizing or pigment coating techniques for paper or board, a coating blade, a grooved small-diameter bar having a diameter of about 10 mm, or a smooth or grooved large-diameter bar having a diameter in a range from about 20 mm to about 50 mm, is used as coating doctors for the roll face in a film size press. It is a disadvantage that small-scale streak formation arises in the film that is formed on the face of the roll in the film size press especially with high running speeds and with high dry solids contents in the coating paste, in particular in film size presses wherein a smooth bar is used. The small-scale streak formation in the film face may also be characterized as cavitation streaks.

In a film size press wherein a coating blade is used, a deposit of coating agent tends to gather at the tip of the blade. This deposit, when it dries, draws streaks in the coating film, and may be broken as particles onto the face of the coating film. The broken particles carried into the size press nip may damage the roll coating in the size press. It may also occur that the deposit separated from the blade tip remains on the roll face after the size press nip, and when it enters further under the coating blade, it produces a scratch in the roll face.

With respect to prior art devices, reference is made to the assignee's Finnish Patent Applications Nos FI 901965 and FI 911345 which describe the use of a large-diameter smooth bar is described in connection with a film size press technique, in particular when the film size press is used for pigment coating of a web with high dry solids contents in the paste, with large coating quantities, and with high coating speeds. FI 901965 corresponds to U.S. Pat. No. 5,122,396, the specification of which is hereby incorporate by reference herein. Further, reference is made to the assignee's Finnish Patent Application No. FI 912260 which describes the use of a twin-loaded blade doctor as coating doctors for the roll faces in a film size press. By utilizing the twin-loaded blade doctor, the device prevents cavitation arising from an incorrect geometry of the coating blade. FI 911345 corresponds to U.S. Pat. No. 5,246,497, the specification of which is hereby incorporated by reference herein. FI 912260 corresponds to U.S. Ser. No. 07/878,862 filed May 5, 1992, (assigned to the same assignee herein) now U.S. Pat. No. 5,286,526, the specification of which is hereby incorporated by reference herein.

In the operation of the above mentioned prior art methods and devices, problems have been encountered in that streaks are formed in the coating film in the film size press. In the situation where a coating blade is used, the streak formation is manifested by the coating paste adhering to the tip of the coating blade, and drying at that location, with resulting streak formation in the coating film. On the other hand, with the use of a large-diameter smooth bar, with high coating speeds higher than about 800 m/min and with high dry solids contents of the paste, e.g., higher than about 50% the coating film in the film size press is scratched with gently curved edges. This streak formation is the result of a cavitation effect as the coating film has been separated from the face of the bar at the trailing side of the bar.

OBJECTS AND SUMMARY OF THE INVENTION

An object of the present invention is to provide improvements in a roll coating method and device by whose means the drawbacks related to the prior art can be avoided and by whose means a significant improvement is achieved in the pigment-coating operation of a film size press, in particular.

It is a further object of the present invention to provide technical embodiments of a roll coating method and device by whose means the technical efficiency of the prior art, in particular of the solutions in accordance with FI Patent Applications Nos. 901965, 911345 and 912260, is increased and improved further.

It is another object of the present invention to provide a new and improved coating method and device in which the formation of streaks is substantially prevented.

In view of achieving the objects stated above, and others, the method in accordance with the invention is mainly characterized in that, adherence of coating agent from the coating-agent film to the trailing side of the coating doctor is prevented by keeping the trailing side of the coating doctor moist or wet. In this manner, the formation of streaks is prevented in the coating-agent film, in particular of streaks resulting from cavitation.

The device in accordance with the present invention includes means for preventing the adhering of coating agent from the coating-agent film to the trailing side of the coating doctor and for keeping the trailing side of the coating doctor moist or wet so as to prevent formation of streaks in the coating-agent film, in particular streaks resulting from cavitation.

In a preferred embodiment of the present invention, the adhering of the coating agent from the coating-agent film to the trailing edge of the coating member, e.g., a coating blade or coating bar, is prevented by feeding a moistening medium as a continuous flow to the trailing side of the coating member. The moistening medium is introduced at the trailing side of the coating member preferably by spraying or atomizing.

The method is based on the fact that the inner cohesion in the coating-agent film that is formed on the roll face is higher than the inner cohesion in the moistening medium. As such, when the coating-agent film is separated from the trailing edge of the coating doctor that is covered by the moistening medium, it does not adhere to the trailing edge of the coating doctor excessively nor firmly, which would result in cleavage of the coating-agent film and in a related cavitation effect.

When a revolving coating bar is used as the coating doctor in the coating method or device, according to an embodiment of the present invention, the bar can be kept moist by rotating the bar in the same direction as the direction of movement of the roll face.

In another embodiment of the present invention, a coating bar used as the coating doctor can be kept moist by cooling it down to a temperature that is substantially lower than the temperature in the environment. In this situation, water from the surrounding air condenses onto the face of the coating bar.

In a further embodiment of the invention, the adherence or adhesion of the coating agent to the coating bar that is used as a coating doctor can be prevented by providing the coating bar with a hydrophobic coating. The hydrophobic coating is preferably made of 'TEFLON', i.e. polytetrafluoroethylene (PTFE).

It is a significant advantage of the present invention over the prior art methods and devices that, in the method and device in accordance with the present invention, it is possible to reduce the streaks in the coating film in a film size press substantially or even to eliminate them completely by preventing adhesion of the coating-agent film to the trailing edge of the coating doctor. As a result, further advantages have been obtained. One particular advantage is that when the present invention is used, the roll coatings are not equally susceptible of being damaged as they were in the prior art. Further advantages and characteristic features of the invention will come out from the following detailed description of the invention.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
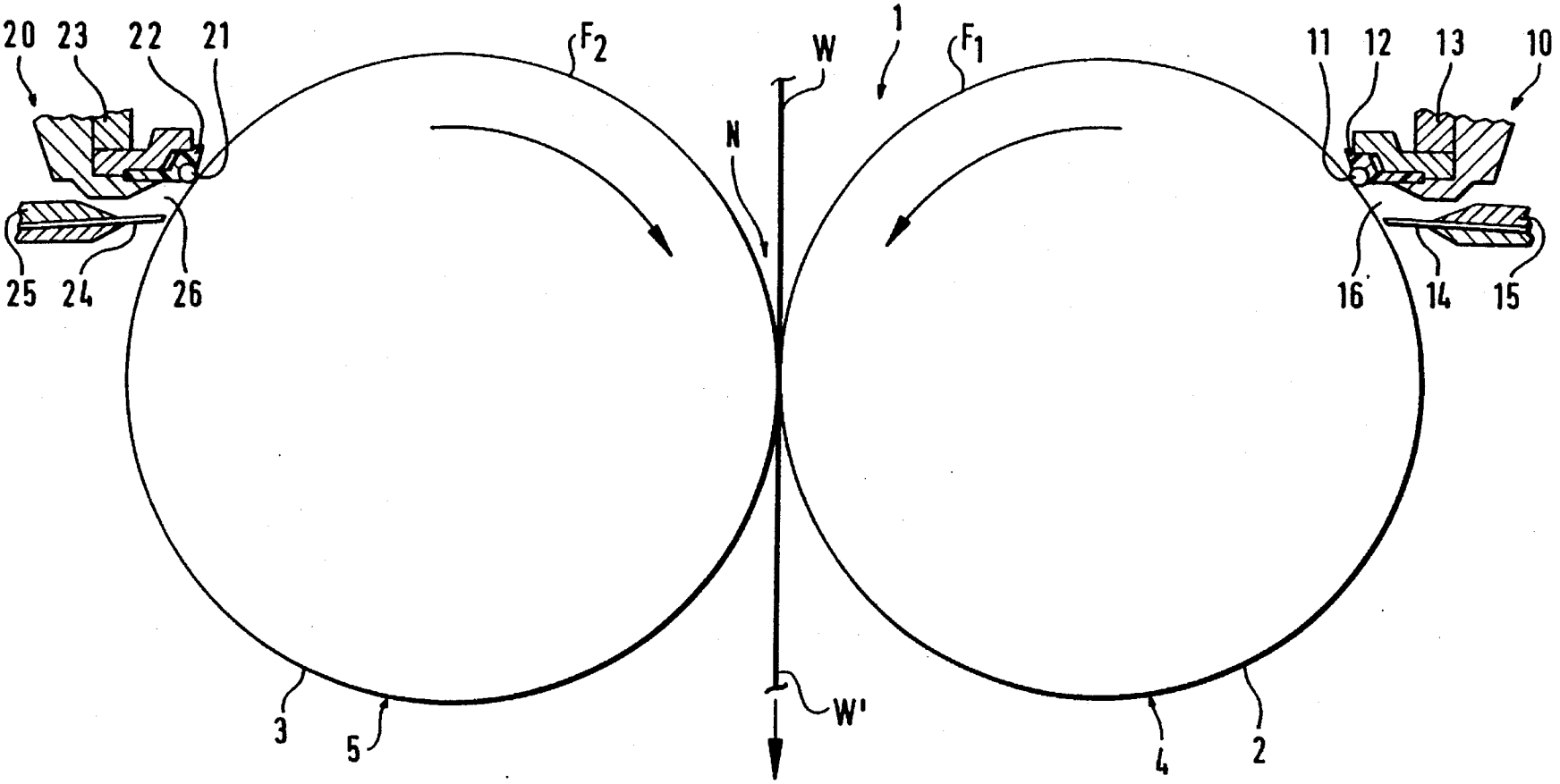
FIG. 1 is a fully schematic side view of a film size press in which the method and device in accordance with the present invention are applied.

FIG. 1 is a schematic illustration of a film size press, which is denoted generally with reference numeral 1. The film size press 1 comprises size press rolls 2 and 3, arranged so that the first roll 2 and the second roll 3 form a nip N with one another. A paper or board web W is passed through the nip N. In the film size press 1, a first size film $F_1$ is metered onto the face of the first roll by means of a first coating device 10, and, in a corresponding manner, a second size film $F_2$ is metered onto the face 5 of the second roll by means of a second coating device 20. In the roll nip N, the size films $F_1$ and $F_2$ are transferred onto the paper or board web W running through the nip. In FIG. 1, the coated web is denoted with reference W'.

In the film size press 1 of the embodiment shown in FIG. 1, the coating devices 10 and 20, by whose means the size films $F_1$ and $F_2$ are applied onto the faces 4 and 5 of the size press rolls 2 and 3, respectively, are bar coaters, which are, as shown in FIG. 1, similar to one another. However, the invention can also be applied to a coating device in which the revolving bar is replaced by a blade doctor instead of the bar coater as in the embodiment shown in FIG. 1.

In the embodiment of FIG. 1, the coating devices 10 and 20 are coating devices of the so-called short-dwell type, in which a coating agent is passed into a pressurized coating-agent chamber 16,26, which is placed before a coating member 11,21. The coating-agent chamber 16,26 is defined by the coating member 11,21, the roll face 4,5, by a front wall 14,24 of the coating-agent chamber, and by possible lateral seals, if any (not shown). The coating member is a coating bar 11,21 arranged in a cradle 12,22 made of a suitable material, for example polyurethane. The cradle supports the coating bar 11,21 over its entire length. The coating bar 11,21 is provided with a purposeful drive gear (not shown), by whose means the coating bar 11,21 is rotated preferably in a direction of rotation opposite to the direction of rotation of the corresponding roll 2,3. In accordance with the present invention, indeed, such an embodiment is also possible in which the coating bar 11,21 is rotated in the same direction as the roll.

Further, in FIG. 1, the holders of the cradles of the coating bars are denoted with reference numerals 13,23, and the holders of the front wall 14,24 with reference numerals 15,25. Between the cradle 12,22 of the coating bar 11,21 and the holder 13,23, a conventional loading hose or equivalent (not shown) is arranged to load the coating bar 11,21 against the roll face 4,5 to produce the desired loading pressure. Other suitable loading means are also appropriate. In the illustration of FIG. 1, a coating bar 11,21 is used as the coating member in the coating devices 10,20. The coating bar 11,21 is smooth-faced or grooved and has a large diameter, the diameter being of in a range from about 20 mm to about 50 mm. However, the present invention can also be applied to a coating device in which the coating bar 11,21 shown in FIG. 1 has been replaced by a blade doctor or by a corresponding coating blade.

Figure 2:
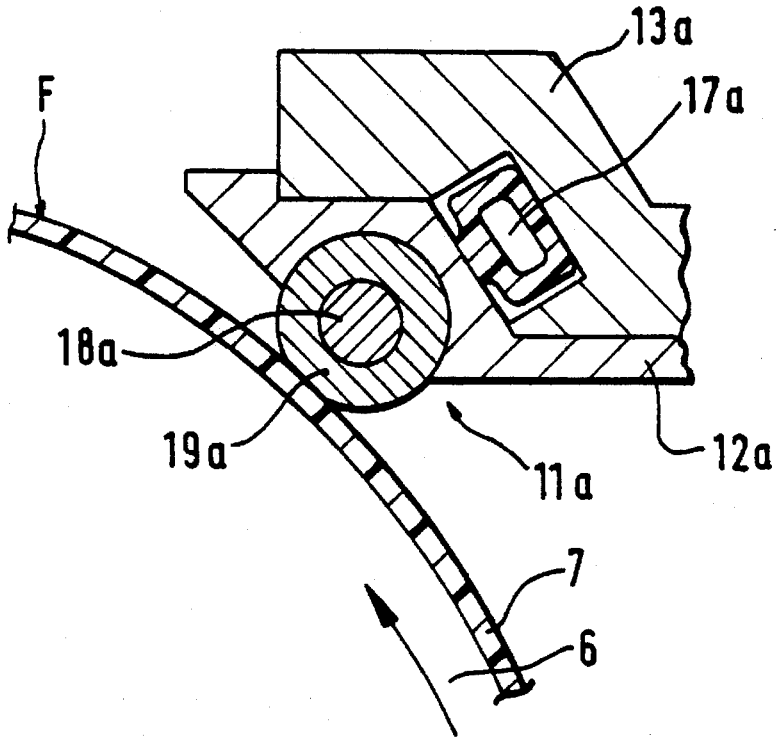
FIG. 2 is an enlarged and simplified illustration of the coating device as shown in FIG. 1, in which the coating member is a bar doctor.

In FIG. 2, shows an alternative embodiment of a part of the coating device shown in FIG. 1 wherein a bar doctor is used as the coating member. In FIG. 2, the size press roll is denoted with reference numeral 6 and the film of coating agent on the roll is denoted with reference F. In a conventional way, the roll is provided with a coating 7, which is, for example, made of rubber or an equivalent material. The coating bar or bar doctor is, in FIG. 2, denoted with reference numeral **11*a*, and in this embodiment of FIG. 2, the coating bar 11*a* comprises a small-diameter body 18*a* of the bar. The bar body 18*a* is provided with a suitable outer layer 19*a*, by whose means the diameter of the bar 11*a* can be made sufficiently large, as desired. The outer layer 19*a* may be made, e.g., of a tube, whose diameter is in a range from about 20 mm to about 50 mm and whose wall thickness is, for example, about 3 mm. Alternatively, the outer layer 19*a* may also consist of bushings or equivalent, arranged on the bar body 18*a* and which are fixed to one another in a suitable way so as to prevent the bushings from revolving. In some cases, the bar 11*a* as a whole can be made of a tube of the size mentioned above without a body part. The bar 11*a* is mounted conventionally to revolve in a cradle 12*a*, which is made, e.g., of polyurethane and fixed to a cradle holder 13*a***.

Loading means are arranged between the cradle holder 13*a* and the cradle 12*a*, e.g., a loading hose 17*a* or an equivalent loading member, to load the bar 11*a* against the roll 6 in the desired way. As shown in FIG. 2, a small-diameter bar body 18*a* is used as the coating bar, or the bar 11*a* is completely constructed of a tube without a body part. In this manner, the loading hose 17*a* operates to profile the bar 11*a* in the same way as a conventional small-diameter bar.

Figure 3:
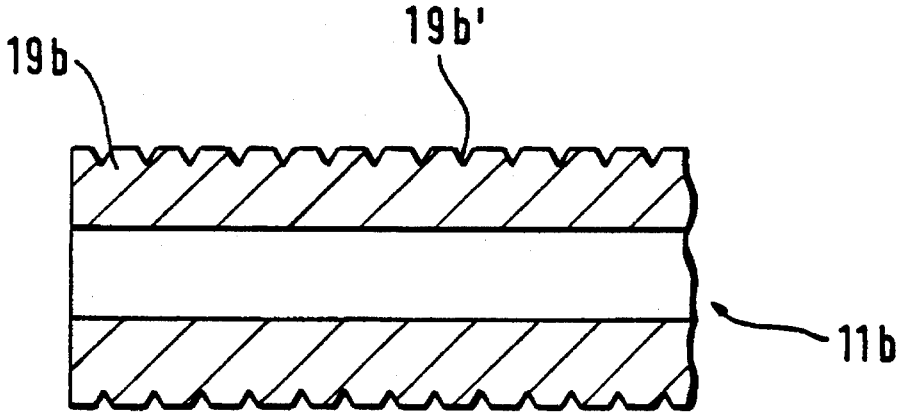
FIG. 3 is a schematic sectional view of an alternative embodiment of the present invention in which the coating bar has a grooved outer surface.

The coating bar 11*a* as shown in FIG. 2 can be smooth-faced, but the face of the bar may also be provided with grooves, as shown schematically in FIG. 3. FIG. 3 is a longitudinal sectional view in part of a coating bar, which is denoted with reference numeral 11*b*. In this embodiment, the bar 11*b* is made of a tube 19*b*, whose outer face is provided with grooves 19*b'*. The material of the tube 19*b* may be, for example, chromium-plated copper or steel. A similar material can also be used in the case of a smooth bar. Grooves 19*b'* can be spiral grooves or circular grooves.

Figure 4:
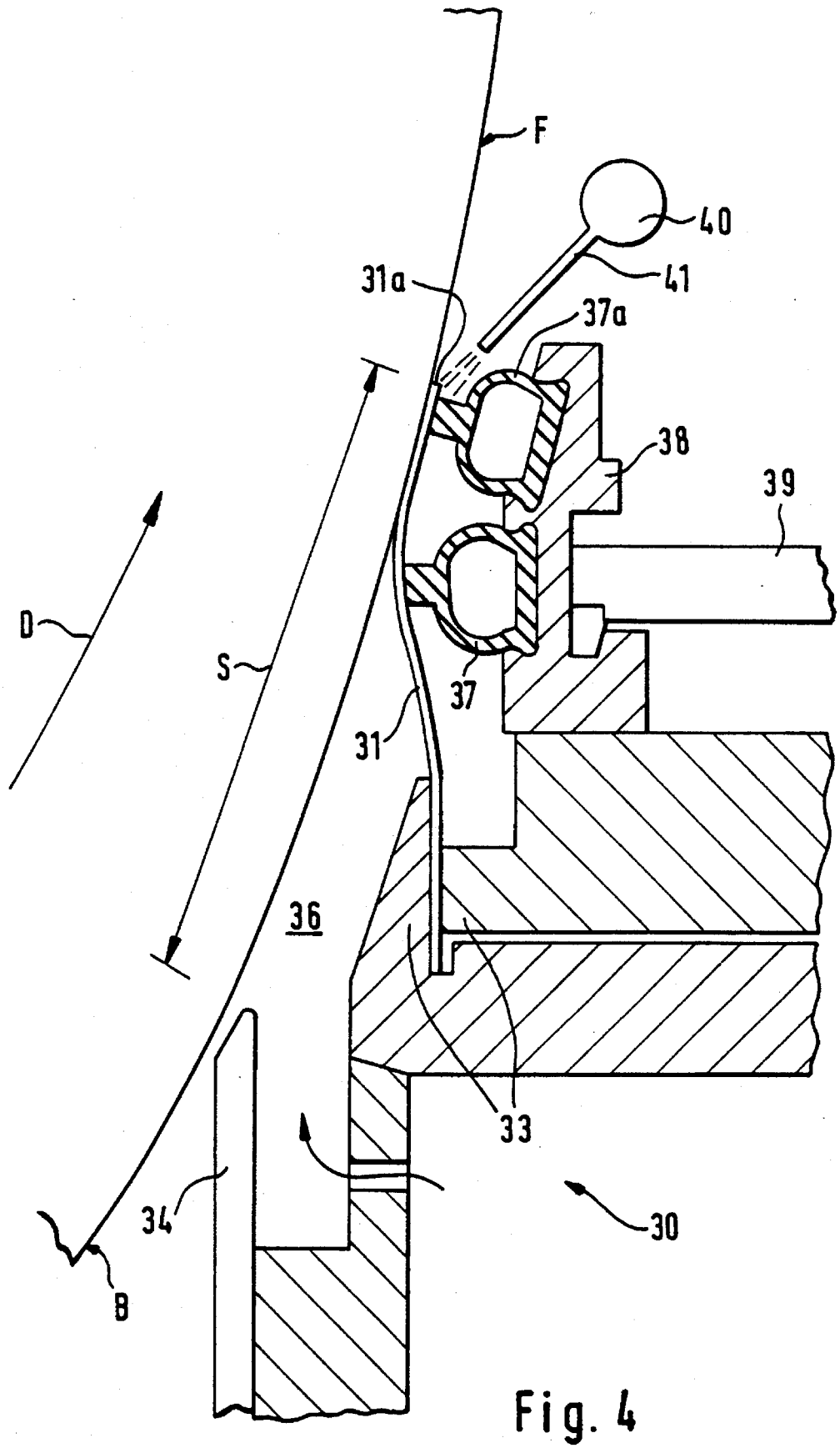
FIG. 4 is a full schematic sectional side view of a twin-loaded blade doctor, to which an embodiment of the present invention is applied.

FIG. 4 shows an embodiment of the device in which the method in accordance with the present invention is used. In FIG. 4, the coating device is denoted generally with reference numeral 30 and includes a coating-agent chamber 36 defined by a coating blade 31, a front wall 34 of the coating-agent chamber, and by lateral seals (not shown). The coating blade 31 rests at a small angle against the face B of the size press roll. The direction of movement of the roll face B is illustrated in FIG. 4 by an arrow denoted with reference D. In the embodiment of FIG. 4, between the roll face B and the front wall 34 of the coating-agent chamber, there is a gap of a specified magnitude which is adjustable if necessary. The overflow of the coating agent from the coating-agent chamber 36 can be regulated by means of the gap. Thus, the coating distance S is defined by the coating blade 31 and the front wall 34 of the coating-agent chamber. The coating agent is in direct contact with the roll face B in the area between the blade and the front wall. The coating agent is introduced into the coating-agent chamber 36 in the conventional way under pressure. Also, the coating-agent chamber may be closed and also pressurized.

The coating blade 31 is attached to the frame of the coating device 30 by means of a blade holder 33. In a conventional way, the frame of the coating device 30 is provided with a loading hose 37, or an equivalent loading member, which is mounted in a holder 38 supported on the frame of the coating device. The loading hose 37 loads the coating blade 31 towards the roll face B in the area between the blade holder 33 and the tip 31*a* of the coating blade. In addition, the coating device 30 may be provided with a regulation device 39, by whose means the holder 38 of the loading hose 37 can be displaced in the coating device 30.

The coating device 30 may also be provided with a second loading member, such as the loading hose 37*a* shown in FIG. 4, by whose means the tip area of the coating blade 31 is loaded towards the roll face B. In the embodiment shown in FIG. 4, the second loading member 37*a* is attached to the same holder 38 with the loading hose 37, but, if necessary, the second loading member 37*a* can be mounted in a separate holder of its own (not shown). In the embodiment shown in FIG. 4, the second loading member 37*a* can be shifted in the horizontal direction, i.e. substantially towards the roll face B and away from the roll face together with the first loading hose 37 or an equivalent loading member by shifting the holder 38 by means of the regulation device 39.

By means of the second loading member 37*a*, the tip 31*a* of the coating blade 31 is substantially prevented from rising apart from the roll face B, whereas, by means of the first loading member 37, the quantity of coating agent is regulated in the conventional way. Thus, by means of this twin loading, separation of the tip 31*a* of the coating blade from the formed coating-agent layer F is prevented, whereby cavitation in the area of the tip 31*a* of the coating blade is substantially eliminated.

However, in the embodiment as shown in FIG. 4, coating agent may adhere from the coating film F to the trailing edge or trailing side of the coating blade 31 or of an equivalent coating doctor. For this reason, the coating device 30 is provided with moistening means 40,41 for moistening and wetting the area of the trailing edge of the coating blade 31 with a liquid, thereby preventing adhering of the coating agent. The means may consist, e.g., of a pipe 40 placed in the transverse direction of the machine and provided with a number of nozzles 41 placed at a distance from one another. Jets of moistening medium are directed through the nozzles at the area of the trailing edge of the coating blade. When the area of the trailing edge of the coating blade 31 is kept moistened in this manner, the coating agent is prevented from adhering to the coating blade. As the moistening medium or agent, it is possible to use, e.g., a liquid, in particular water, a gas, steam, an emulsion, a dispersion, or mixtures thereof. In tests carried out with a test machine, it has been noted that the application of steam provides particularly superior moistening results.

Figure 5:
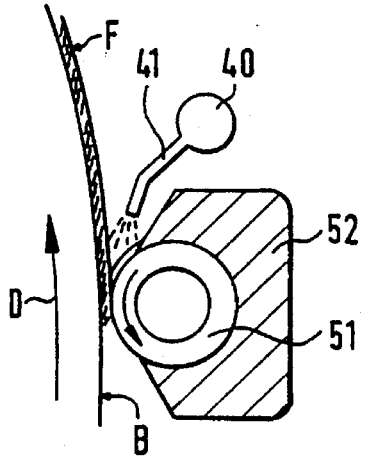
FIGS. 5, 6, 7, 8, and 9 are full schematic illustrations of alternative embodiments of the invention as applied in connection with a bar doctor.

In FIG. 5, an embodiment of the present invention is shown in which the application of the coating agent as a film F onto the face B of the size press roll is carried out by means of a bar doctor, preferably by means of a large-diameter smooth-faced or grooved bar 51. The diameter of the bar is preferably in a range from about 20 mm to about 50 mm. FIG. 5 has been simplified to a considerable extent so that only the face B of the size press roll and the coating bar 51 that is mounted revolvingly in a cradle 52 are shown. The construction of the coating device itself may be, for example similar to that shown in FIG. 1 concerning the coating devices 10,20, or similar to that shown in FIG. 2. The coating agent is brought into the coating device in a suitable manner, in the direction of rotation D of the roll, before the coating bar 51 which spreads and smooths the film F of the coating agent on the roll face B. As illustrated in FIG. 5 by an arrow, the coating bar 51 is rotated in a direction opposite to the direction of rotation D of the roll.

As explained above, the use of such a large-diameter coating bar causes the drawback that scratches occur in the coating film F in particular with high coating speeds and with high dry solids contents of the paste. The scratches result from a cavitation effect on separation of the coating film from the face of the coating bar 51 at the trailing side of the bar. In the embodiment of FIG. 5, the coating device is provided with means 40,41 similar to those described in FIG. 4, by which means a moistening medium is fed to the trailing side 51 of the coating bar, whereby the coating bar 51 is kept moistened in order to substantially eliminate the cavitation effect. In a manner corresponding to FIG. 4, means 40,41 may consist, e.g., of a pipe 40 arranged substantially transverse to the machine direction and provided with a number of nozzles 41 fitted in the transverse direction of the machine.

Figure 6:
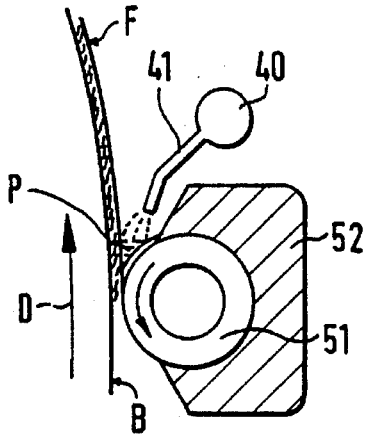

The embodiment of FIG. 6 is, in the other respects, identical with that shown in FIG. 5, with the exception that, in the embodiment of FIG. 6, the moistening agent is fed to the trailing side of the coating bar 51 in a large quantity so that a pool P of the moistening agent is formed at the trailing side of the coating bar 51. In this embodiment, the cavitation effect and the resulting scratches can be prevented even more efficiently than in the embodiment shown in FIG. 5. The moistening means can be the same as those described in connection with the embodiment of FIG. 4. In test runs with a test machine, it was noted that this embodiment operates excellently, in particular when silicon atomization is employed.

Figure 7:
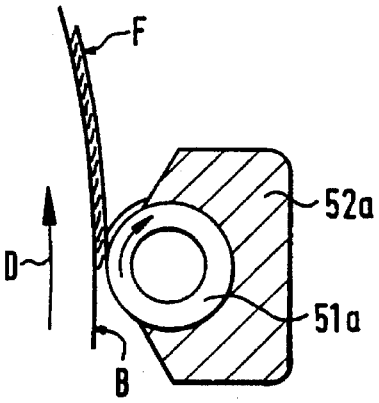

The embodiment of the invention shown in FIG. 7 is similar to the embodiments shown in FIGS. 5 and 6, however, in the embodiment of FIG. 7, the specific external means for moistening the trailing side of the coating bar (40,41 as shown in FIGS. 4–6) have been omitted. In FIG. 7, the coating bar is denoted with reference numeral 51*a*, and the cradle of the coating bar is denoted with reference numeral 52*a*. In the embodiment of FIG. 7, the coating bar 51*a* is kept moist and the cavitation effect is prevented by arranging the coating bar 51*a* to rotate in the same direction as the direction of rotation D of the roll, i.e. with the direction of movement of the roll face B. As such, the trailing side of the coating bar 51*a* remains constantly wet and moistened with the coating agent. A separate moistening and wetting system is not needed. The rotation of the coating bar 51*a* in this "downstream" direction might cause the drawback that coating agent is transferred from the face of the bar onto the face of the upper lip of the cradle 52*a*, from where it might crack onto the film F that has been formed on the roll face. This situation can, however, be avoided, for example, by providing a device (not shown) for periodic or continuous cleaning of the upper face of the cradle 52*a*.

Figure 8:
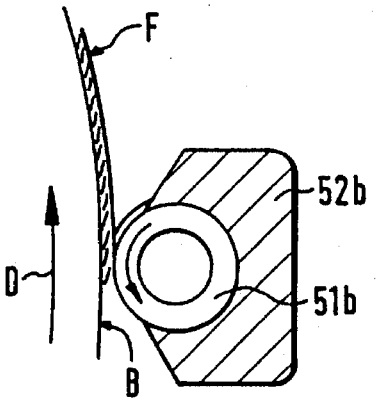

In FIG. 8, an embodiment of the present invention is shown which is similar to the embodiments shown in FIGS. 5 to 7. In the manner corresponding to FIG. 7, in this embodiment, the specific external means for moistening of the face of the coating bar (40,41 as shown in FIGS. 4–6) have also been omitted. In FIG. 8, the coating bar is denoted with reference numeral 51*b* and the cradle of the coating bar is denoted with reference numeral 52*b*. As indicated by an arrow in FIG. 8, the direction or sense of rotation of the coating bar 51*b* is opposite to the direction of movement D of the roll face B. In fact, this embodiment can also be applied in the case that the sense of rotation of the coating bar 51*b* is equal to the direction of movement D of the roll face B. In the embodiment of FIG. 8, the moistening of the coating bar 51*b* has been arranged so that the coating bar 51*b* is cooled, in which case its temperature is substantially lower than the temperature of the environment. As the coating bar 51 is cold, water from the surrounding air condenses onto the face of the coating bar. Thus, by means of this solution, the detrimental cavitation effect can also be avoided.

The cooling of the coating bar 51*b* can be arranged, e.g., so that the coating bar 51*b* is provided with an axial through hole, through which a circulation of cooling medium is arranged. In such a case, the coating bar 51*b* is tubular in the manner described, e.g., in connection with the description related to FIGS. 2 and 3. Alternatively, exterior cooling means can be provided.

Figure 9:
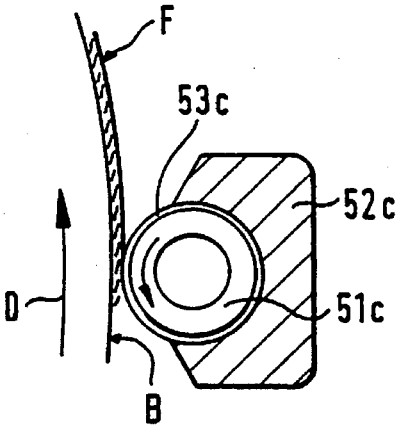

In FIG. 9, a further embodiment of the present invention is shown, which is also similar to the embodiments shown in FIGS. 5 to 8. As in the embodiments of FIGS. 7 and 8, the coating device is not provided with specific external means for passing a moistening medium to the trailing side of the coating bar. In FIG. 9, the coating bar is denoted with reference numeral 51*c* and the coating-bar cradle is denoted with reference numeral 52*c*. In the embodiment of FIG. 9, adhesion of the coating agent to the trailing side of the coating bar 51*c* and the resulting cavitation effect are prevented by providing a coating 53*c* of a hydrophobic, i.e. moisture-rejecting, material on the coating bar 51*c*.

The examples provided above are not meant to be exclusive. Many other variations of the present invention would be obvious to those skilled in the art, and are contemplated to be within the scope of the appended claims.

I claim:

1. In a method for coating a face of a roll in a film size press with a coating agent by means of a coating device having a machine width in which a rotatable coating bar extends across the machine width and is loaded against the roll, the coating agent being introduced into the coating device and applied onto the roll face before the coating bar in a direction of rotation of the roll and being spread and smoothed by the coating bar on the roll face in a coating nip, the improvement comprising the steps of:

rotatingly securing the coating bar in a cradle, applying a quantity of moistening medium to a trailing side of the coating bar at a location exterior of the cradle to prevent adhesion of coating agent to the trailing side of the coating bar and thereby prevent the formation of streaks in the coating agent film, and maintaining the application of the moistening medium during rotation of the coating bar such that substantially the entire circumferential surface of the coating bar is kept moist.

2. The method of claim 1, further comprising the step of introducing the moistening medium into the area of the trailing side of the coating bar by spraying or atomizing.

3. The method of claim 1, further comprising the step of feeding the moistening medium to the trailing side of the coating bar as a continuous flow.

4. The method of claim 3, further comprising the step of forming a pool of moistening medium at the trailing side of the coating bar by regulating the quantity of the moistening medium fed to the trailing side of the coating bar.

5. The method of claim 1, wherein the moistening medium comprises a liquid, a gas, steam, an emulsion, a dispersion, or mixtures thereof.

6. The method of claim 1, further comprising the step of rotating the coating bar in the same direction as the direction of rotation of the roll.

7. The method of claim 1, further comprising the step of providing a hydrophobic coating on the coating bar.

8. The method of claim 1, further comprising the step of rotating the coating bar in a direction of rotation opposite to the direction of rotation of the roll.

9. A method for coating a face of a roll in a film size press with a coating agent by means of a coating device, comprising arranging a rotatable coating bar in the coating device, applying the coating agent onto a face of the roll, loading the coating bar against the face of the roll to spread and smooth the coating agent as a film on the face of the roll, moistening a trailing side of the coating bar to keep the coating doctor wet and prevent adhesion of coating agent to the trailing side of the coating bar and thereby prevent the formation of streaks in the coating agent film, and feeding a moistening medium to an area of the trailing side as a continuous flow by spraying or atomizing to moisten the trailing side of the coating bar rotating the coating bar while maintaining the feeding of the moistening medium such that substantially the entire circumferential surface of the coating bar is kept moist.

10. In a method for coating a face of a roll in a film size press with a coating agent by means of a coating device having a machine width in which a rotatable coating bar extends across the machine width and is loaded against the roll, the coating agent being introduced into the coating device and applied onto the roll face before the coating bar in a direction of rotation of the roll and being spread and smoothed by the coating bar on the roll face in a coating nip, the improvement comprising the steps of:

Introducing a quantity of moistening medium into an area of a trailing side of the coating bar by spraying or atomizing such that the moistening medium is applied to the trailing side of the coating bar to prevent adhesion of coating agent to the trailing side of the coating bar and thereby prevent the formation of streaks in the coating agent film, and maintaining the introduction of the moistening medium during rotation of the coating bar such that substantially the entire circumferential surface of the coating bar is kept moist.

11. In a method for coating a face of a roll in a film size press with a coating agent by means of a coating device having a machine width in which a rotatable coating bar extends across the machine width and is loaded against the roll, the coating agent being introduced into the coating device and applied onto the roll face before the coating bar in a direction of rotation of the roll and being spread and smoothed by the coating bar on the roll face in a coating nip, the improvement comprising the steps of:

applying a quantity of moistening medium onto a trailing side of the coating bar to prevent adhesion of coating agent to the trailing side of the coating bar and thereby prevent the formation of streaks in the coating agent film, said step of applying the moistening medium comprising the step of cooling the coating bar to a temperature substantially lower than atmospheric temperature to thereby cause a quantity of water constituting the moistening medium to condense onto the coating bar, and maintaining the application of the moistening medium during rotation of the coating bar such that substantially the entire circumferential surface of the coating bar is kept moist.

12. An apparatus for coating a face of a roll in a film size press, comprising a coating device in which a coating agent is applied onto the face of the roll, a rotatable coating bar arranged in said coating device and extending across a machine width thereof, said coating bar having a trailing side, a cradle in which said coating bar is rotatingly secured, loading means arranged in association with said cradle for loading said coating bar against the face of the roll such that said coating bar spreads and smooths the coating agent as a film on the face of the roll in a coating nip, and moistening means for applying a moistening medium to the trailing side of the coating bar such that upon rotation of the coating bar, substantially the entire circumferential surface of the coating bar is kept moist or wet and formation of streaks in the coating agent film is prevented, said moistening means being arranged to apply the moistening medium to the trailing side of said coating bar at a location exterior of said cradle.

13. The apparatus of claim 12, wherein said moistening means comprise means for passing a moistening medium as a continuous flow to the trailing side of the coating bar.

14. The apparatus of claim 13, wherein the moistening medium comprises a liquid, a gas, steam, an emulsion, a dispersion, or mixtures thereof.

15. The apparatus of claim 12, wherein said coating bar is a large-diameter revolving coating bar having a smooth face and a diameter from about 20 mm to about 50 mm.

16. The apparatus of claim 12, wherein said coating bar is a large-diameter, grooved revolving coating bar having a diameter from about 20 mm to about 50 mm.

17. The apparatus of claim 12, wherein said coating bar is arranged to revolve in a direction of movement corresponding to a direction of rotation of the roll.

18. The apparatus of claim 12, further comprising means for cooling the coating bar to a temperature lower than atmospheric temperature whereby the difference between the cooled temperature of the coating bar and the atmospheric temperature causes water to condense on the coating bar.

19. The apparatus of claim 12, wherein said coating bar has a hydrophobic coating.

20. The apparatus of claim 19, wherein said hydrophobic coating is polytetrafluoroethylene.

21. The apparatus of claim 12, wherein said coating bar is arranged to revolve in a direction of movement opposite to a direction of rotation of the roll.

* * * * *